US009711091B2

(12) United States Patent
Wang

(10) Patent No.: US 9,711,091 B2
(45) Date of Patent: Jul. 18, 2017

(54) 3D DISPLAY METHOD AND DISPLAY DEVICE

(71) Applicant: SHENZHEN CHINA STAR OPTOELECTRONICS TECHNOLOGY CO., LTD., Shenzhen (CN)

(72) Inventor: Zui Wang, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/416,434

(22) PCT Filed: Aug. 26, 2014

(86) PCT No.: PCT/CN2014/085215
§ 371 (c)(1),
(2) Date: Jan. 22, 2015

(87) PCT Pub. No.: WO2016/023247
PCT Pub. Date: Feb. 18, 2016

(65) Prior Publication Data

US 2016/0049119 A1 Feb. 18, 2016

(30) Foreign Application Priority Data

Aug. 13, 2014 (CN) ..... 2014 1 0398419

(51) Int. Cl.
*G09G 5/10* (2006.01)
*G09G 3/34* (2006.01)
(Continued)

(52) U.S. Cl.
CPC ..... *G09G 3/3406* (2013.01); *G09G 3/2074* (2013.01); *G09G 3/3614* (2013.01);
(Continued)

(58) Field of Classification Search
CPC .. G09G 3/3406; G09G 3/2074; G09G 3/3696; G09G 2320/0209;
(Continued)

(56) References Cited

U.S. PATENT DOCUMENTS 8,055,070 B2 * 11/2011 Bassi ..... G09G 3/2003 382/167
8,212,764 B2 7/2012 Song et al.
(Continued)

FOREIGN PATENT DOCUMENTS

CN 101188093 A 5/2008
CN 101325035 A 12/2008
(Continued)

OTHER PUBLICATIONS

International Search Report and Written Opinion (Forms PCT/ISA/220, PCT/ISA/237 and PCT/ISA/210) issued on May 13, 2015, by the State Intellectual Property Office of China in corresponding International Application No. PCT/CN2014/085215. (11 pages).
(Continued)

*Primary Examiner* — Vijay Shankar
(74) *Attorney, Agent, or Firm* — Buchanan Ingersoll & Rooney PC

(57) ABSTRACT

The present disclosure discloses a 3D display method and a display device, relates to the field of display technologies, and can improve the 3D display effects of a Vertical Alignment (VA) liquid crystal display. The 3D display method comprises the steps of: acquiring effective grayscale of an image to be displayed; acquiring compensation data for brightness of the image to be displayed based on the effective grayscale thereof; and driving, during display of the image, a backlight source based on the compensation data for brightness, so as to compensate for brightness of the image to be displayed. The 3D display method is especially
(Continued)

suitable for a VA display device. The present disclosure can be used in a display device, such as a liquid crystal television, a liquid crystal display, a mobile phone, a tablet personal computer, etc.

10 Claims, 3 Drawing Sheets

(51) Int. Cl.
*G09G 3/20* (2006.01)
*G09G 3/36* (2006.01)

(52) U.S. Cl.
CPC ..... *G09G 3/3696* (2013.01); *G09G 2320/028* (2013.01); *G09G 2320/0209* (2013.01); *G09G 2320/0233* (2013.01); *G09G 2320/0242* (2013.01); *G09G 2340/0457* (2013.01)

(58) Field of Classification Search
CPC ... G09G 2320/0233; G09G 2320/0626; G09G 2320/0646; G09G 3/34; G09G 3/36; G09G 3/20; G09G 5/06
USPC ..... 345/76–102, 204–215, 690
See application file for complete search history.

(56) References Cited

U.S. PATENT DOCUMENTS 8,442,316 B2 * 5/2013 Bassi ..... G06T 5/008 345/55
8,648,883 B2 * 2/2014 Han ..... G09G 3/2003 345/690
8,743,188 B2 * 6/2014 Kim ..... H04N 13/0422 348/42
8,797,366 B2 8/2014 Choe et al.
8,836,621 B2 * 9/2014 Takatori ..... G09G 3/2014 345/100
8,952,882 B2 2/2015 Lin et al.
9,135,864 B2 * 9/2015 Shields ..... G09G 3/3406
2008/0117162 A1 * 5/2008 Song ..... G09G 3/2092 345/102
2008/0122874 A1 * 5/2008 Han ..... G09G 3/2003 345/690
2008/0166043 A1 * 7/2008 Bassi ..... G09G 3/2003 382/167
2010/0165222 A1 * 7/2010 Choi ..... G09G 3/3648 349/15
2010/0225674 A1 * 9/2010 Choe ..... G09G 3/3406 345/690
2011/0157252 A1 6/2011 Yamazaki et al.
2011/0285763 A1 11/2011 Bassi et al.
2011/0310090 A1 * 12/2011 Kim ..... G02B 27/2264 345/419
2012/0147138 A1 * 6/2012 Yu ..... G02B 27/26 348/43
2012/0147161 A1 * 6/2012 Kim ..... H04N 13/0422 348/58
2012/0287172 A1 * 11/2012 Lin ..... G09G 3/3426 345/690
2013/0106923 A1 * 5/2013 Shields ..... G09G 3/3406 345/690
2015/0255025 A1 9/2015 Chen et al.

FOREIGN PATENT DOCUMENTS

CN 101630493 A 1/2010
CN 101826313 A 9/2010
CN 102214446 A 10/2011
CN 102314850 A 1/2012
CN 102497561 A 6/2012
CN 103177422 A 6/2013
CN 103325355 A 9/2013
CN 103943080 A 7/2014

OTHER PUBLICATIONS

Office Action issued on Nov. 4, 2015, by the State Intellectual Property Office of China in corresponding Chinese Application No. 201410398419.7. (6 pages).
Office Action issued May 5, 2016, by the State Intellectual Property Office of China, in corresponding Chinese Patent Application No. 201410398419.7 (7 pages).

* cited by examiner

3D DISPLAY METHOD AND DISPLAY DEVICE

The present application claims benefit of Chinese patent application CN 201410398419.7, entitled "3D display method and display device" and filed on Aug. 13, 2014, the entirety of which is incorporated herein by reference.

FIELD OF THE INVENTION

The present disclosure relates to the field of display technologies, in particular to a 3D display method and a display device.

BACKGROUND OF THE INVENTION 3D liquid crystal displays (LCDs) not only have the benefits of ultra-thinness, energy conservation, and the like of an LCD, but also allow users to directly discern the distances of the objects in an image, so as to obtain more comprehensive and authentic information. Therefore, 3D LCDs have broad application prospects.

During operation of an LCD, liquid crystal molecules would be deteriorated under a long-term function of an electric field in one and the same direction. Even if the voltage applied to the liquid crystal molecules is removed, the light transmittance of the liquid crystal molecules may not be restored to a level before application of the voltage, thus causing undesirable phenomena, such as severe blurring of images on the LCD, etc. Therefore, in order to prevent deterioration of liquid crystal molecules, it would be necessary to frequently change the direction of the electric field that is applied to the liquid crystal molecules.

Based on the forgoing, in order to avoid deterioration of liquid crystal molecules in a 3D LCD and meanwhile ensure the display effects of the 3D LCD, a 3D drive method has been proposed in the prior art, in which the direction of the electric field can be reversed. Specifically, the direction of the electric field is reversed after the left eye image and the right eye image of one picture have both been displayed.

The inventor has discovered, during the effort for achieving the present disclosure, that the above 3D drive method cannot be applied to a Vertical Alignment (VA) LCD. This is because the pixel of a VA LCD generally employs a charge sharing technology in order to guarantee a large viewing angle display of the VA LCD. That is, one pixel is divided into two sub-pixels, and the large viewing angle display of the VA LCD is achieved by lowering the brightness of either of the two sub-pixels. The above 3D drive method in the prior art would cause unfavorable conditions on the VA LCD, such as different brightness between the left and the right images and crosstalk between the left and right eyes' images on one and the same picture, etc., thus reducing the 3D display effects of the VA LCD and affecting users' experience.

SUMMARY OF THE INVENTION

The technical problem to be solved by the present disclosure is to provide a 3D display method and a 3D display device that can improve 3D display effects of a VA LCD.

In order to solve the above technical problem, the present disclosure adopts the following technical solutions.

According to a first aspect of the present disclosure, a 3D display method is provided, comprising the steps of:

acquiring effective grayscale of an image to be displayed;

acquiring compensation data for brightness of the image to be displayed based on the effective grayscale thereof; and driving, during display of the image, a backlight source based on the compensation data for brightness, so as to compensate for brightness of the image to be displayed.

The 3D display method further comprises pre-setting the compensation data for brightness of the effective grayscale of the image to be displayed, and storing the same in a compensation lookup table for brightness.

The compensation data for brightness include intensity of driving current or length of driving time of the backlight source.

Acquiring the effective grayscale of the image to be displayed includes acquiring the grayscale that occupies the largest area in the image to be displayed as the effective grayscale, preferably acquiring the grayscale that occupies the largest area in the middle of the image to the displayed as the effective grayscale.

Acquiring the effective grayscale of the image to be displayed includes acquiring the effective grayscale of the image to be displayed every other frame.

The technical solution provided in the embodiments of the present disclosure discloses a 3D display method, through which specific compensation for brightness of a picture displayed on a display device can be performed. Specifically, corresponding compensation data for brightness can be acquired based on the effective grayscale of an image to be displayed, and the brightness of the image to be displayed can be compensated for by using the acquired compensation data for brightness during display of the image. This method is beneficial for ensuring the same brightness of the left and right images on one and the same picture, thus preventing occurrence of undesirable conditions, such as crosstalk between the left and right eyes' images, etc. As a result, the 3D display effects of the VA LCD can be guaranteed, and users' experience can be improved.

According to a second aspect of the present disclosure, a 3D display device is provided, comprising:

a first acquisition module, used for acquiring effective grayscale of an image to be displayed;

a second acquisition module, used for acquiring compensation data for brightness of the image to be displayed based on the effective grayscale thereof; and a driving module, used for driving, during display of the image, a backlight source based on the compensation data for brightness, so as to compensate for brightness of the image to be displayed.

The 3D display device further comprises a setting and storage module, used for pre-setting the compensation data for brightness of the effective grayscale of the image to be displayed, and storing the same in a compensation lookup table for brightness.

The compensation data for brightness include intensity of driving current or length of driving time of the backlight source.

The first acquisition module is specifically used for acquiring the grayscale that occupies the largest area in the image to be displayed as the effective grayscale, preferably for acquiring the grayscale that occupies the largest area in the middle of the image to be displayed as the effective grayscale.

The first acquisition module is specifically used for acquiring the effective grayscale of the image to be displayed every other frame.

Other features and advantages of the present disclosure will be further explained in the following description, and partly become self-evident therefrom, or be understood through implementing the embodiments of the present disclosure. The objectives and advantages of the present disclosure will be achieved through the structure specifically pointed out in the description, claims, and the accompanying drawings.

BRIEF DESCRIPTION OF THE DRAWINGS

In order to explain the technical solution in the embodiments of the present disclosure in a clearer manner, the accompanying drawings used in the following description will be briefly explained, in which.

DETAILED DESCRIPTION OF THE EMBODIMENTS

The present disclosure will be explained by reference to the following detailed description of embodiments taken in connection with the accompanying drawings, whereby it can be readily understood how to solve the technical problem by the technical means according to the present disclosure and achieve the technical effects thereof, and thus the technical solution according to the present disclosure can be implemented. It is important to note that as long as there is no conflict, combinations of the above-described embodiments and of technical features therein are possible, and technical solutions obtained in this manner are intended to be within the scope of the present disclosure.

Embodiment One

Figure 1:
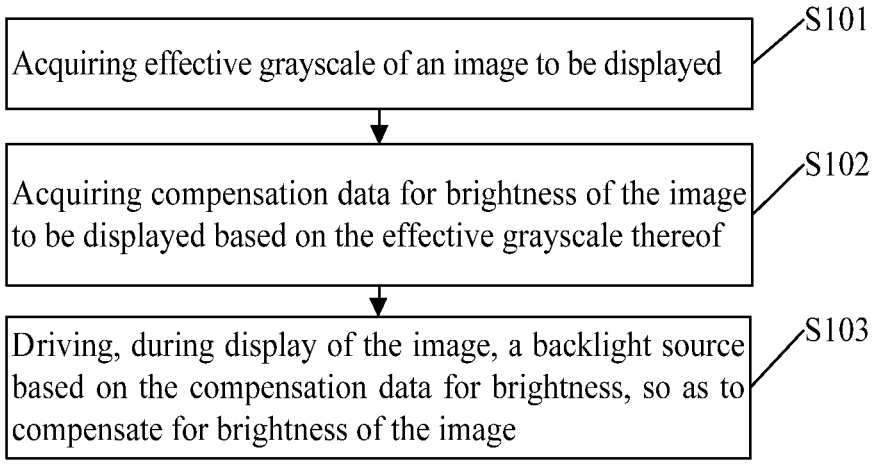
FIG. 1 schematically shows a flowchart I of a 3D display method according to the embodiments of the present disclosure.

This embodiment of the present disclosure provides a 3D display method. As FIG. 1 shows, the 3D display method can comprise the following steps.

In step S101, the effective grayscale of an image to be displayed is acquired.

In this embodiment of the present disclosure, the image to be displayed refers to an image which has been read out but not yet output or displayed by a display device. Specifically, the grayscale that occupies the largest area in the image to be displayed can be acquired as the effective grayscale. Preferably, the grayscale that occupies the largest area in the middle of the image to be displayed can be acquired as the effective grayscale. Obviously, there can be a plurality of methods for acquiring the effective grayscale, which are not be restricted by this embodiment of the present disclosure.

In step S102, a compensation data for brightness of the image to be displayed is acquired based on the effective grayscale thereof.

In step S103, during display of the image, a backlight source is driven based on the compensation data for brightness, so as to compensate for brightness of the image.

In order to guarantee a large viewing angle display of a VA display device, the pixel of the VA display device can generally employ a charge sharing technology. That is, one pixel can be divided into two sub-pixels, and the large viewing angle display of the VA LCD can be achieved by lowering the brightness of either of the two sub-pixels. If a conventional 3D display method is used, in which the direction of an electric field is reversed after the left and right eyes' images of one and the same picture are displayed, different brightness between the left and right images of one and the same picture would arise on the VA display device, thus resulting in unfavorable conditions, such as crosstalk between the left and right eyes' images, etc.

Therefore, this embodiment of the present disclosure discloses a 3D display method, through which specific compensation for brightness of a picture displayed on a display device can be performed. Specifically, corresponding compensation data for brightness can be acquired based on the effective grayscale of the image to be displayed, and during display of the image, the brightness of the image to be displayed can be compensated for by using the acquired compensation data for brightness. This method is beneficial for ensuring the same brightness of the left and right images on one and the same picture, thus preventing occurrence of unfavorable conditions, such as crosstalk between the left and right eyes' images and the like. As a result, the 3D display effects of the VA LCD can be guaranteed, and users' experience can be improved.

Figure 2:
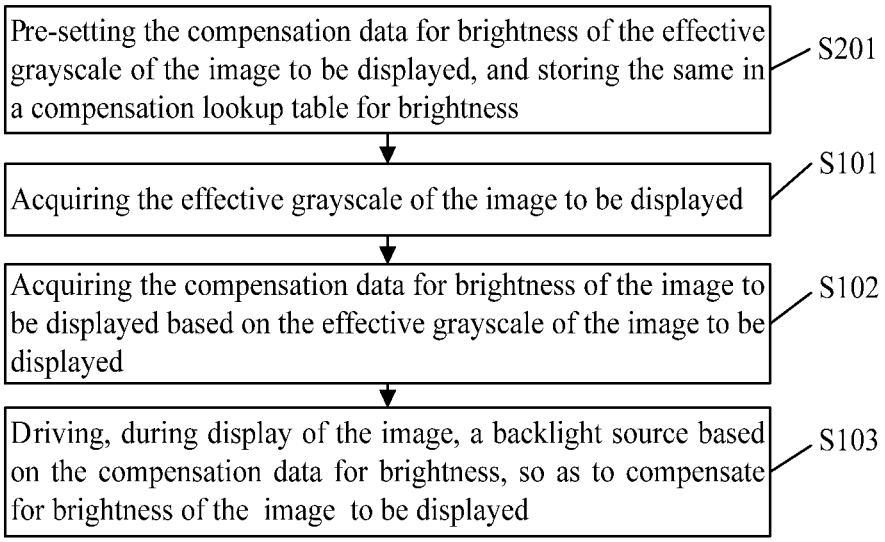
FIG. 2 schematically shows a flowchart II of the 3D display method according to the embodiments of the present disclosure.

Further, the 3D display method disclosed by this embodiment of the present disclosure can comprise the following step before step S101, as FIG. 2 shows.

In step S201, the compensation data for brightness of the effective grayscale of the image to be displayed can be pre-set and stored in a compensation lookup table for brightness.

In the present embodiment of the present disclosure, the compensation data for brightness can be intensity of driving current, or length of driving time of the backlight source.

Generally, each 3D picture displayed can comprise two frames of images, i.e., a left-eye image and a right-eye image, respectively. The left-eye image and right-eye image may have a slight difference therebetween, and are taken or processed according to a parallax angle which exists between a user's left eye and right eye at the time of observing one and the same object. Thus, only when the left-eye image and the right-eye image can both be normally displayed at a high quality, can the user observe ideal 3D display effects on the display device.

Therefore, step S201 can comprise: pre-setting the compensation data for brightness of the left eye based on the effective grayscale of the left-eye image to be displayed, and storing the same in a compensation lookup table for brightness of the left eye; and pre-setting the compensation data for brightness of the right eye based on the effective grayscale of the right-eye image to be displayed, and storing the same in a compensation lookup table for brightness of the right eye.

Specifically, in this embodiment of the present disclosure, an ideal brightness value can be pre-set as actually required. Subsequently, the brightness of the left-eye image and the right-eye image of each effective grayscale on a VA display device under a 3D mode can be obtained. The gap between the brightness of each left-eye image and the ideal brightness value can be calculated to obtain backlight compensation data for brightness of the left eye image corresponding to each left-eye brightness gap. The obtained backlight compensation data for brightness of the left eye can be stored in a compensation look-up table for brightness of the left eye as shown in table 1 that follows, and referred to by the display device when compensating for the brightness of the left-eye image.

TABLE 1

| Effective grayscale | Intensity of driving current (left) | Length of driving time (left) |
|---|---|---|
| 0 | IL0 | TL0 |
| 1 | IL1 | TL1 |
| 2 | IL2 | TL2 |
| 3 | IL3 | TL3 |
| . . . | . . . | . . . |
| 254 | IL254 | TL254 |
| 255 | IL255 | TL255 |

Similarly, through calculation of the gap between the brightness of each right-eye image and the ideal brightness value, backlight compensation data for brightness of each right-eye image can be obtained. The obtained backlight compensation data can be stored in a compensation look-up table for brightness of the right eye image as shown in table 2 that follows, and referred to by the display device when compensating for the brightness of the right-eye image.

TABLE 2

| Effective grayscale | Intensity of driving current (right) | Length of driving time (right) |
|---|---|---|
| 0 | IR0 | TR0 |
| 1 | IR1 | TR1 |
| 2 | IR2 | TR2 |
| 3 | IR3 | TR3 |
| . . . | . . . | . . . |
| 254 | IR254 | TR254 |
| 255 | IR255 | TR255 |

A current image to be displayed can be either a left-eye image or a right-eye image. Therefore, in step S102, the compensation data for brightness of the left eye corresponding to the effective grayscale can be acquired when the image to be displayed is judged as a left-eye image.

Subsequently, in step S103, a backlight source can be driven based on the compensation data for brightness of the left eye during display of the image, so as to compensate for brightness of the image to be displayed.

Obviously, in step S102, the compensation data for brightness of the right eye corresponding to the effective grayscale can also be acquired when the image to be displayed is judged as a right-eye image.

Subsequently, in step S103, a backlight source can be driven based on the compensation data for brightness of the right eye during display of the image, so as to compensate for brightness of the image to be displayed.

Figure 3:
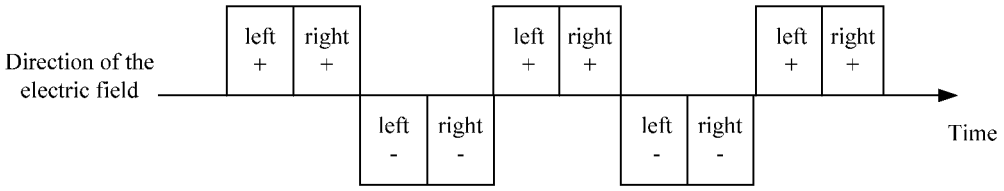
FIG. 3 schematically shows reversion of the direction of an electric field according to the embodiments of the present disclosure.
Figure 4:
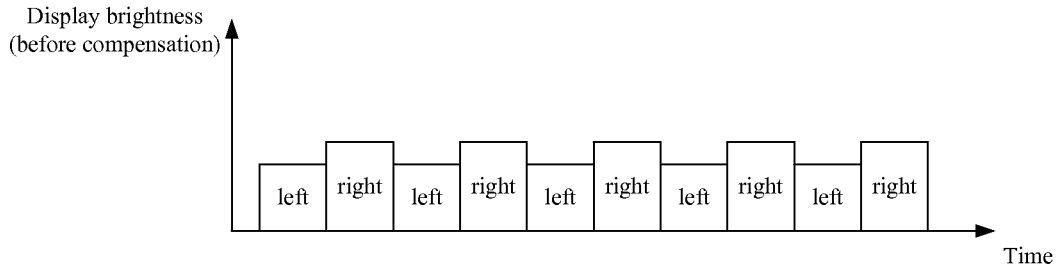
FIG. 4 schematically shows display brightness before compensation according to the embodiments of the present disclosure.

For example, the left-eye image and right-eye image together constitute each 3D picture that is displayed, and the electric fields of two pictures displayed in succession are of opposite directions, as FIG. 3 shows. A first picture and a second picture will be explained as an example in the following. Since the electric fields displaying the first and second pictures are of opposite directions, a reversion of electric field direction must take place after displaying the right-eye image of the first picture and before displaying the left-eye image of the second picture. Due to the role of the charge sharing technology in the VA display device, the reversion of the electric field will lead to such a small amount of charge carried by a pixel electrode of the display device that the liquid crystal molecules cannot be adequately driven. This would render the brightness of the left-eye image of the second picture rather dim, as FIG. 4 shows, while the right-eye image of the second picture can be normally displayed.

The left-eye image of the second picture, after being read out by the display device and before being output by the display device, will be an image to be displayed by the display device. The image to be displayed will be judged as a left-eye image or a right-eye image, and the effective grayscale thereof will be obtained. After the image to be displayed is judged to be a left-eye image by the display device, corresponding compensation data for brightness of the left eye can be obtained from the compensation lookup table for brightness of the left eye based on the effective grayscale. Correspondingly, the compensation data for brightness at this moment is in the form of the intensity of driving current of the backlight source. As a result, the display brightness of the left-eye image of the second picture can be improved.

Correspondingly, the right-eye image of the second picture, after being read out by the display device and before being output by the display device, will be an image to be displayed by the display device. The image to be displayed will be judged as a left-eye image or a right-eye image, and the effective grayscale thereof will be obtained. After the image to be displayed is judged to be a right-eye image by the display device, corresponding compensation data for brightness of the right eye can be obtained from the compensation lookup table for brightness of the right eye based on the effective grayscale. Correspondingly, the compensation data for brightness of the right eye at this moment is in the form of the intensity of driving current of the backlight source. As a result, the display brightness of the right-eye image of the second picture can be improved.

Figure 5:
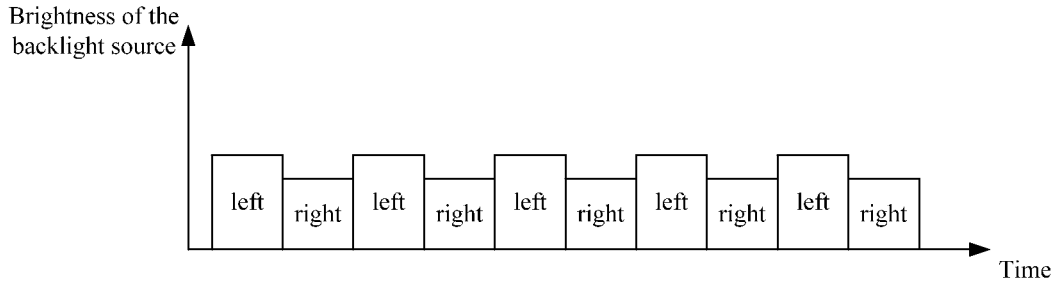
FIG. 5 shows a diagram I of the driving effects of a backlight source according to the embodiments of the present disclosure.

As shown in FIG. 5, after compensation, the brightness of the backlight source during display of the left-eye image of the second picture can be greater than that of the backlight source during display of the right-eye image of the second picture.

Figure 6:
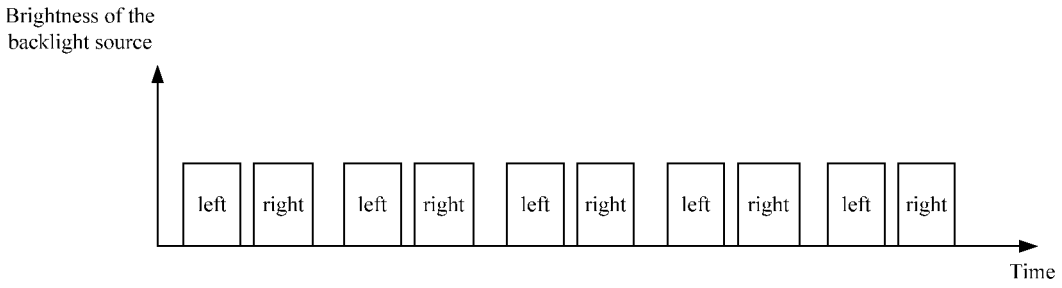
FIG. 6 shows a diagram II of the driving effects of the backlight source according to the embodiments of the present disclosure.

In addition, the compensation data for brightness may also be the length of driving time of the backlight source. As shown in FIG. 6, obviously, the backlight source for the left-eye image and that for the right-eye image of the second picture have the same brightness at this moment. However, influenced by the compensation data for brightness, the illumination duration of the backlight source is longer when the left-eye image is displayed than when the right-eye image is displayed.

Figure 7:
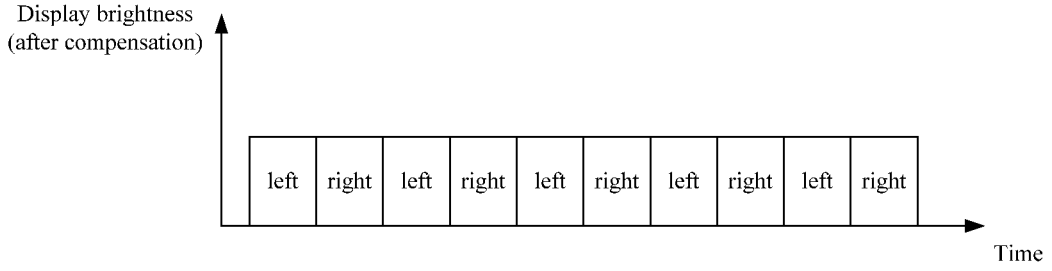
FIG. 7 schematically shows the display brightness after compensation according to the embodiments of the present disclosure.

FIG. 7 shows the display effects after compensation for the condition of FIG. 4 by the manner shown in FIG. 5 or FIG. 6. It is obvious that at this moment, the left-eye image and the right-eye image substantially have the same brightness for users, thus ensuring the users' viewing effects. However, it should be noted that, in this case, the display brightness of FIG. 4 will be greater after being compensated by the manner shown in FIG. 6 than being compensated by the manner shown in FIG. 5.

It should be noted that, as an example, the first image frame of each picture has been explained as a left-eye image in the above. Obviously, the first image frame of each picture may also be a right-eye image. This will not be limited by the embodiment of the present invention.

According to the foregoing description, for a VA display device, the direction of the electric field would be reversed after the display of each picture is completed, so that the brightness of the first image frame of each picture will be reduced, while the brightness of the second image frame can be normal; that is, the brightness of the first image frame is smaller than that of the second image frame. Thus, it will be only necessary to compensate for the brightness of the first image frame or the second image frame of each picture, so as to render the brightness of the first image frame and that of the second image frame equal.

In this case, step S101 can comprise acquiring the effective grayscale of the image to be displayed every other frame. That is, steps S102 and S103 can be performed after acquiring the effective grayscale of only the first image frame or the second image frame.

It is obvious that the first image frame can be either a left-eye image or a right-eye image. Correspondingly, the second image frame can also be either a right-eye image or a left-eye image. Thus, if compensation is only necessary for brightness of the first image frame, it needs to determine whether the first image frame is a left-eye image or a right-eye image. Subsequently, the corresponding compensation data for brightness can be obtained based on the determination result, and the backlight source during display of the first image frame can be driven based on the compensation data for brightness, thereby compensating for the brightness of the first image frame. In this case, the brightness of the second image frame may not be processed. It can be ensured that the difference in brightness between the first image frame and the second image frame can be reduced or eliminated as long as the backlight source is normally driven, thus ensuring users' 3D viewing effects.

Embodiment Two

Figure 8:
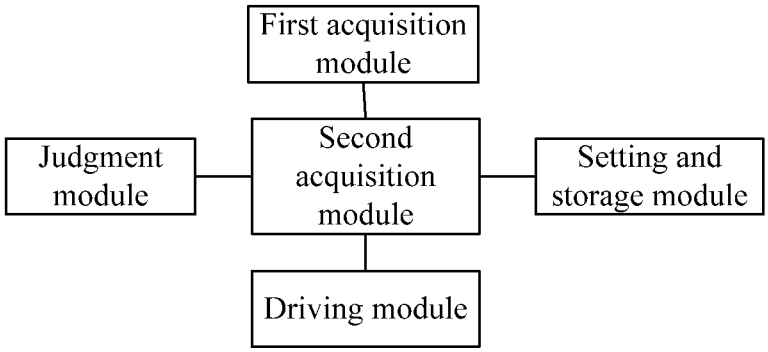
FIG. 8 schematically shows the structure of a 3D display device according to the embodiments of the present disclosure.

This embodiment provides a 3D display device as shown in FIG. 8. The 3D display device can comprise a first acquisition module, which can be used for acquiring effective grayscale of an image to be displayed.

The first acquisition module can be specifically used for acquiring the grayscale that occupies the largest area in the image to be displayed as the effective grayscale, preferably for acquiring the grayscale that occupies the largest area in middle of the image to be displayed as the effective grayscale.

The 3D display device can also comprise a second acquisition module, which can be used for acquiring compensation data for brightness of the image to be displayed based on the effective grayscale thereof.

The 3D display device can further comprise a driving module, which can be used for driving, during display of the image, a backlight source based on the compensation data for brightness, so as to compensate for brightness of the image.

As FIG. 8 indicates, the 3D display device can further comprise a setting and storage module, which can be used for pre-setting the compensation data for brightness of the effective grayscale of the image to be displayed, and storing the same in a compensation lookup table for brightness.

In the embodiment of the present disclosure, the compensation data for brightness can include intensity of driving current or length of driving time of the backlight source.

Generally, each 3D picture displayed can comprise two frames of images, i.e., a left-eye image and a right-eye image, respectively. The left-eye image and right-eye image may have a slight difference therebetween, and are taken or processed according to a parallax angle which exists between a user's left eye and right eye at the time of observing one and the same object. Thus, only when the left-eye image and the right-eye image can both be normally displayed at a high quality, can the user observe ideal 3D display effects on the display device.

Therefore, the setting and storage module can be specifically used for pre-setting the compensation data for brightness of the left eye based on the effective grayscale of the left-eye image to be displayed, and storing the same in a compensation lookup table for brightness of the left eye, and also for pre-setting the compensation data for brightness of the right eye based on the effective grayscale of the right-eye image to be displayed, and storing the same in a compensation lookup table for brightness of the right eye.

Since a current image to be displayed can be either a left-eye image or a right-eye image, as FIG. 8 shows, the 3D display device can further comprise a judgment module, which can be used for judging whether the image to be displayed is a left-eye image or a right-eye image.

Hence, if the judgment module determines the image to be displayed as a left-eye image, the second acquisition module will be used for obtaining, from the setting and storage module, compensation data for brightness of the left eye corresponding to the effective grayscale, while the driving module will be used for, during display of the image, driving the backlight source based on the acquired compensation data for brightness of the left eye.

Alternatively, if the judgment module determines the image to be displayed as a right-eye image, the second acquisition module will be used for obtaining, from the setting and storage module, compensation data for brightness of the right eye corresponding to the effective grayscale, while the driving module will be used for, during display of the image, driving the backlight source based on the acquired compensation data for brightness of the right eye.

For a VA display device, after the direction of electric field is changed, the brightness of the first image frame of each picture will be reduced, while the brightness of the second image frame can be normal; that is, the brightness of the first image frame is smaller than that of the second image frame. Thus, it will be only necessary to compensate for the brightness of the first image frame or the second image frame of each picture, so as to render the brightness of the first image frame and that of the second image frame equal.

The first acquisition module can further be specifically used for acquiring the effective grayscale of the image to be displayed every other frame.

While the embodiments of the present disclosure are described above, the description should not be construed as limitations of the present disclosure, but merely as embodiments for readily understanding the present disclosure. Anyone skilled in the art, within the spirit and scope of the present disclosure, can make amendments or modification to the implementing forms and details of the embodiments. Hence, the scope of the present disclosure should be subjected to the scope defined in the claims.

The invention claimed is:

1. A 3D display device, comprising:

a first acquisition module, used for acquiring effective grayscale of an image to be displayed every other frame;

a second acquisition module, used for acquiring compensation data for brightness of the image to be displayed based on the effective grayscale thereof; and a driving module, used for driving, during display of the image, a backlight source based on the compensation data for brightness, so as to compensate for brightness of the image to be displayed.

2. The 3D display device of claim 1, further comprising a setting and storage module, used for pre-setting the compensation data for brightness of the effective grayscale of the image to be displayed, and storing the same in a compensation lookup table for brightness.

3. The 3D display device of claim 2, wherein the compensation data for brightness include intensity of driving current or length of driving time of the backlight source.

4. The 3D display device of claim 1, wherein the first acquisition module is specifically used for acquiring the grayscale that occupies the largest area in the image to be displayed as the effective grayscale.

5. The 3D display device of claim 1, wherein the first acquisition module is configured to acquire the effective grayscale of the image to be displayed only every other frame.

6. A 3D display method, comprising the steps of:

acquiring effective grayscale of an image to be displayed every other frame;

acquiring compensation data for brightness of the image to be displayed based on the effective grayscale thereof; and driving, during display of the image, a backlight source based on the compensation data for brightness, so as to compensate for brightness of the image to be displayed.

7. The 3D display method of claim 6, further comprising pre-setting the compensation data for brightness of the effective grayscale of the image to be displayed, and storing the same in a compensation lookup table for brightness.

8. The 3D display method of claim 7, wherein the compensation data for brightness include intensity of driving current or length of driving time of the backlight source.

9. The 3D display method of claim 6, wherein acquiring the effective grayscale of the image to be displayed includes acquiring the grayscale that occupies the largest area in the image to be displayed as the effective grayscale.

10. The 3D display method of claim 6, wherein acquiring the effective grayscale of the image to be displayed includes acquiring the effective grayscale of the image to be displayed only every other frame.

* * * * *